US005711123A

United States Patent [19]

Lamont et al.

[11] Patent Number: 5,711,123

[45] Date of Patent: Jan. 27, 1998

[54] DECORATIVE MOULDING WITH REMOVABLE DECORATIVE PANEL

[75] Inventors: Bernard Lamont, Gatineau; David Rozon, Russell, both of Canada

[73] Assignee: 2844788 Canada Ltée, Hull, Canada

[21] Appl. No.: 685,021

[22] Filed: Jul. 22, 1996

Related U.S. Application Data

[60] Provisional application No. 60/008/613 Dec. 14, 1995.

[51] Int. Cl.[6] ..... E04B 2/00

[52] U.S. Cl. ..... 52/287.1; 52/288.1; 52/312; 52/716.1; 40/661.03; 40/650

[58] Field of Search ..... 52/287.1, 288.1, 52/312, 313, 718.02, 311.3, 716.1; 40/649, 658, 650, 661.03, 661.06

[56] References Cited

U.S. PATENT DOCUMENTS

| | | | |
|---|---|---|---|
| 2,190,958 | 2/1940 | Clute | 40/650 |
| 2,317,192 | 4/1943 | Hopp | 40/650 |
| 2,451,581 | 10/1948 | Slavsky et al. | 40/650 |
| 2,888,983 | 6/1959 | Toti | 160/38 |
| 2,894,571 | 7/1959 | Toti | 160/38 |
| 2,935,804 | 5/1960 | Duckro | 40/650 |
| 3,302,350 | 2/1967 | Brown et al. | 52/287 |
| 3,956,861 | 5/1976 | Rasmussen | 52/287 |
| 4,189,888 | 2/1980 | Blitzer, Jr. | 52/311.1 X |
| 4,274,237 | 6/1981 | Hagstrom | 52/312 |
| 4,334,372 | 6/1982 | Colmar | 40/650 |
| 4,958,458 | 9/1990 | Hillstrom et al. | 40/647 X |
| 5,001,877 | 3/1991 | Edwards | 52/288 |
| 5,444,956 | 8/1995 | Searer et al. | 52/312 |

FOREIGN PATENT DOCUMENTS

| | | | |
|---|---|---|---|
| 2191518 | 12/1987 | United Kingdom | 52/287.1 |

*Primary Examiner*—Carl D. Friedman
*Assistant Examiner*—Winnie S. Yip
*Attorney, Agent, or Firm*—Adrian Zahl

[57] ABSTRACT

The invention is a decorative molding characterized by an elongate channel recessed into its front face and adapted to releasably retain an elongate strip-like panel in either a concavely-flexed position or a flat or convex position. Retention means for the releasable retention of the panel are incorporated into the channel. The retention means comprise two pairs of elongate, spaced-apart flanges that extend towards the floor of the channel and partly occlude the mouth of the channel. The flanges are shaped to retain a panel in a concave position within the channel by means of the upper and lower side edges of the panel being retained between respective pairs of flanges, or in a flat or convex position by means of retention between the free edges of the flanges and the floor of the channel. The invention also comprises the combination of a molding with panel-retaining means and a decorative panel that comprises an elongate strip-like sheet having sufficient rigidity to retain its position within the channel while being retained only along its side edges.

18 Claims, 4 Drawing Sheets

FIG. 6

DECORATIVE MOULDING WITH REMOVABLE DECORATIVE PANEL

The present invention was disclosed in our previously-filed U.S. provisional patent application No. 60/008,613, filed on Dec. 14, 1995.

FIELD OF THE INVENTION

The present invention relates to a decorative moulding for interior use, such as a crown or cornice moulding for installation at a wall/ceiling intersection or a baseplate moulding. With suitable adaptations, the moulding may also be used to form a valance for installation over a window or the like.

BACKGROUND OF THE INVENTION

Decorative mouldings such as crown or cornice mouldings are typically fabricated from wood or other rigid workable material. Typically, a homeowner installs such mouldings only once in the life of a house, and the mouldings are thus impervious to decor changes within the home. While a homeowner may switch the decor of a house from, for example, traditional to modern styles, the mouldings will typically remain firmly entrenched in the original style. There is a need for a moulding that can be readily adapted to suit different styling needs of a homeowner.

A related need is the ability of a moulding to coordinate with other elements of the decor of the house, such as window blinds, drapes, rugs, furniture or countertops. It is desirable to provide a means to permit the moulding to incorporate the same material as, for example, a countertop or window blind vane in order to permit the moulding to visually coordinate with these elements.

A further need in the field is for a moulding that is relatively easy to install and finish.

One approach to meet the aesthetic needs outlined above is to provide a moulding the front face of which comprises a removable decorative cover plate or panel. The moulding may be fabricated from wood, plastic or other relatively rigid material. For example, U.S. Pat. No. 4,274,237 (Hagstrom) discloses an extruded plastic moulding, with a channel recessed into the front face adapted to releasably retain a decorative cover plate. In this case, the device is intended to serve as trim for a desk or other furniture. The same principle has been applied to interior moulding for installation against a wall, in U.S. Pat. No. 5,444,956 (Searer et al.).

These prior art examples are adapted to retain a generally planar decorative cover panel in a flat position. It may be desirable for decorative purposes to provide a curved or bowed appearance to the panel, with the panel being arced concavely or convexly, when seen in cross-section. Further, where it is desired to use as an insert a relatively flexible material, it is desirable to concavely flex the panel to retain it within the channel without buckling. This is of significance where it is desired to coordinate the moulding with a window blind by using as a decorative panel a strip of material that also serves as a vane of the window blind, which may comprise pliable plastic or fabric. This feature permits the moulding to coordinate visually with the window blinds within a room.

SUMMARY OF THE INVENTION

The present invention addresses these needs by providing a decorative moulding characterized by an elongate channel recessed into the front face of the moulding. The channel is adapted to releasably retain an elongate strip-like panel in either a concavely-flexed position or a flat or convex position. The channel is defined by upper and lower sidewalls and a recessed floor. Retention means for the releasable retention of a panel are incorporated within each of the sidewalls.

The retention means each comprise a pair of elongate, spaced-apart extensions that extend towards the floor of the channel and partly occlude the mouth of the channel. The extensions, which may comprise flanges that extend substantially the length of the channel, are oriented such that a panel may be retained in a concave position within the channel by means of the upper and lower side edges of the panel being retained between respective pairs of extensions, or in a flat or convex position by means of retention between the extensions and the floor of the channel. In the arrangement where the extensions comprise flanges, an outer of each flange within the pair of flanges may be outwardly bowed to permit a panel to be snap-fitted behind the flanges. In the concave orientation, the concave flex of the panel serves to retain it within the retainer member without buckling. If the panel is relatively stiff, for example if it comprises extruded plastic or aluminum, it is not necessary to achieve a concave flex. For this application, the panel may be either planar or have a convex curvature.

In order to better retain a flat or convex panel, the sidewalls of the moulding may bow outwardly to provide a recessed portion, with the edges of the panel being retained within the recessed portion.

The sidewalls of the retainer member may incorporate a decorative border extending as a flange laterally outwardly away from the mouth of the channel.

The invention further comprises the combination of a moulding as defined above, with a decorative panel. The panel comprises an elongate strip-like sheet having sufficient rigidity to retain its position within the channel while being retained only along its side edges. The panel may comprise either a generally flat strip that may be retained in a planar position; a relatively flexible strip that may be retained in a concave configuration within the retainer member; or a pre-curved generally rigid strip that may be retained within the retainer member in either a convex or concave position.

The decorative panel may comprise the same stiffened cloth or PVC plastic material as the vane of a window blind, or any other type of rigid or semi-rigid material. A moderate degree of rigidity is required to prevent the panel from sagging within the retainer member.

The mouldings described herein may be mated with corner caps to cover the exposed ends of the moulding at an inside or outside corner. A corner cap comprises in general terms a hollow member having a similar exterior profile as the mouldings but with a larger cross-sectional profile. This gives the corner cap a stepped appearance at the point where the mouldings meet the cap.

The directional references herein refer to a moulding in a conventional position, as it would be when installed against a wall, with the terms "forward" referring to the outward direction away from the wall and "rearward" meaning towards the wall.

DETAILED DESCRIPTION OF THE PREFERRED EMBODIMENTS

Figure 1:
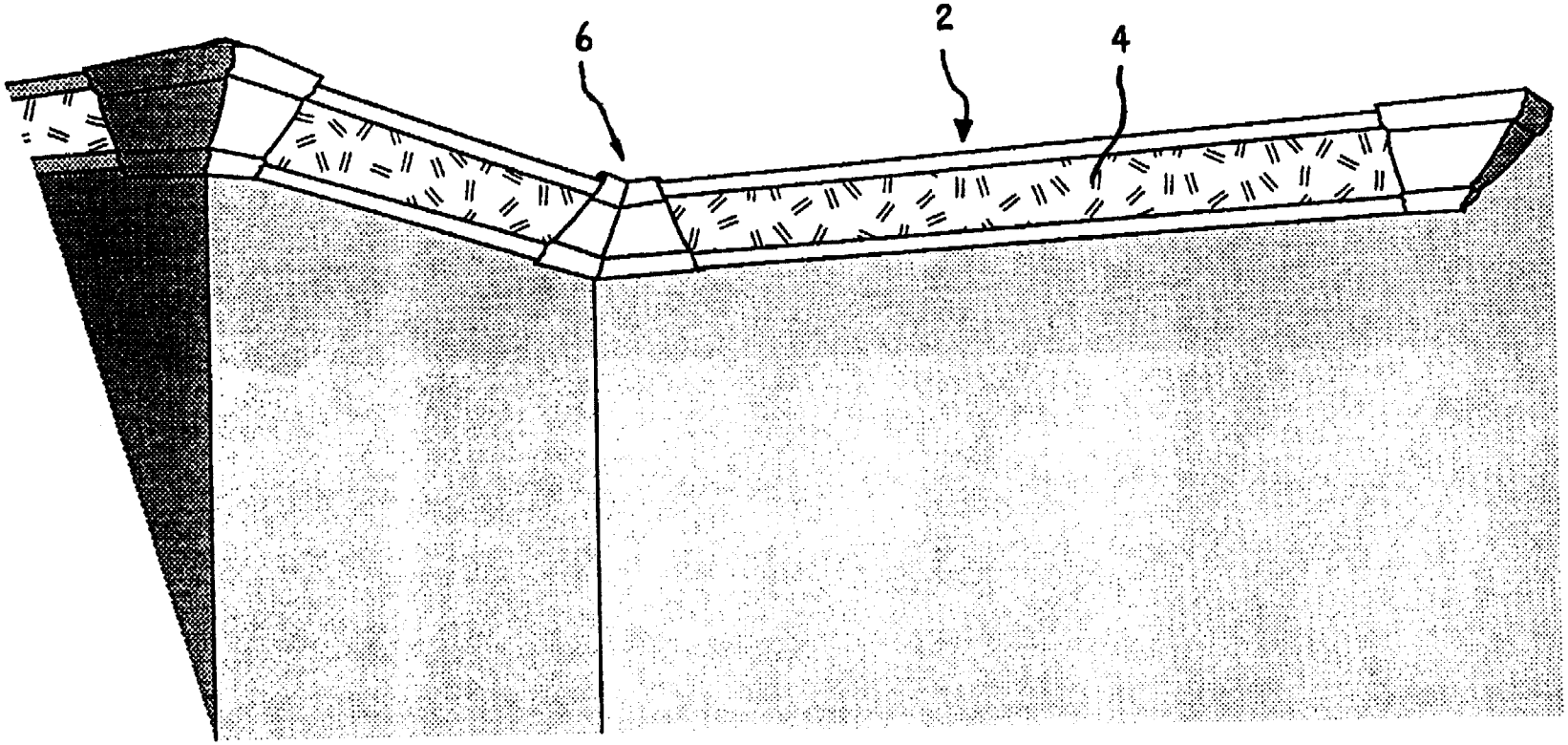
FIG. 1 is a perspective view of a portion of abutting mouldings and a corner cap installed at the corner of a room.

A typical moulding installation according to the present invention may comprise a crown or cornice moulding, baseplate, chair rail or other species of moulding. With suitable modifications, the mouldings may also be used to assemble a valance of the type comprised of three rigid panels defining a box-like structure. A crown moulding is described and illustrated herein by way of illustration. As seen in FIG. 1, the moulding comprises in general terms an elongate linear member 2, the front face of which is substantially covered by a removable decorative panel 4. Corner caps 6 cover the exposed ends of the moulding at the room corners. The mouldings are adapted to be installed against or parallel to a straight stretch of wall, although with suitable modifications it may be curved.

Figure 2:
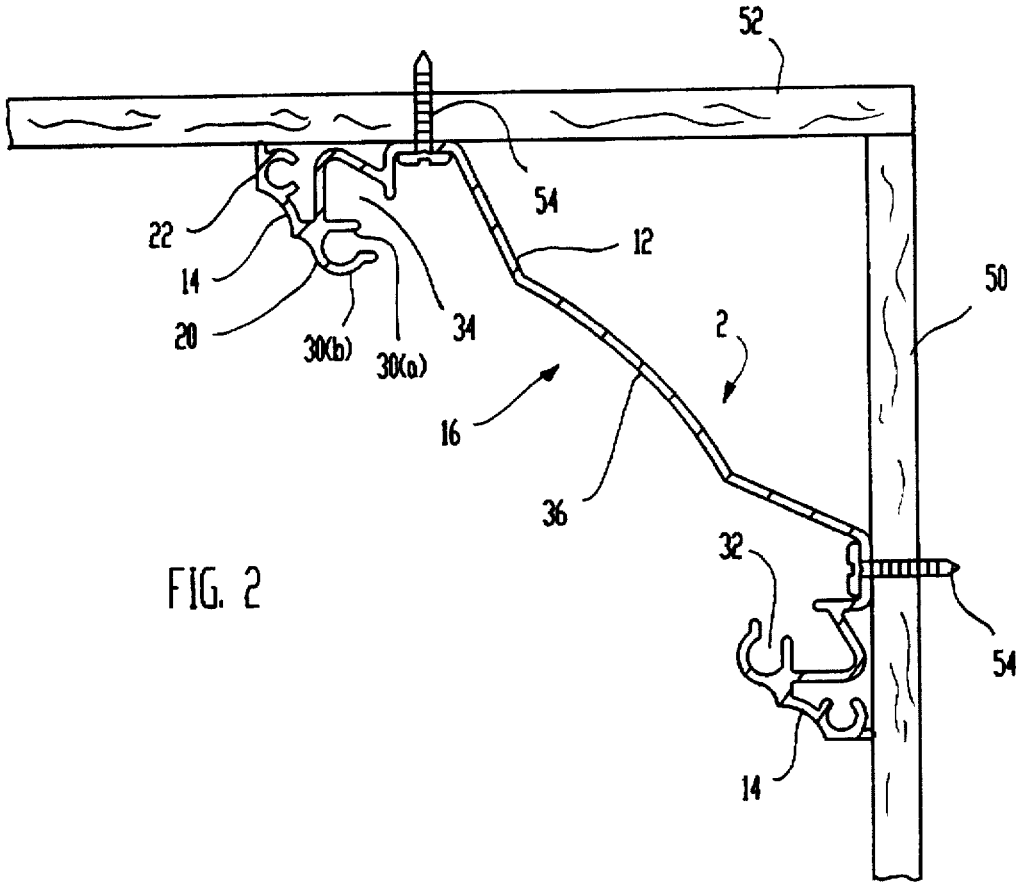
FIG. 2 is a sectional view of a retainer member, installed at a wall-ceiling intersection.
Figure 3:
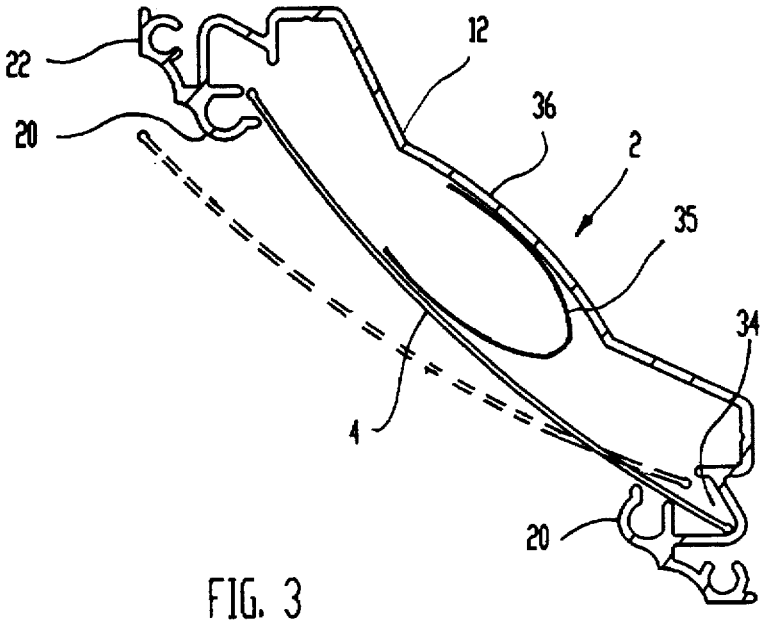
FIG. 3 is a sectional view, with a decorative panel shown both in a convexly-retained position and in dotted lines in a partially detached position.

Turning to FIGS. 2 and 3, the elongate member 2 is generally channel-shaped with a generally U-shaped profile defined by a floor 12 and sidewalls 14. The respective sidewalls define a mouth 16. The sidewalls 14 flare generally outwardly to permit the moulding to be installed at a wall/ceiling intersection. When seen in section, the sidewalls are generally T-shaped. One limb of the top of the "T" forms a lip 20 partly occluding the mouth 16. Together, the two lips are adapted to retain the decorative panel 4 within the channel. The opposing limb of the "T" defines a flange 22 that forms a decorative border extending outwardly from the mouth 16 of the moulding. The lips 20 each comprise a pair of elongate, spaced-apart flanges, consisting of a straight inner flange 30(*a*) and an outwardly-bowed outer flange 30(*b*) extending rearwardly into the interior of the channel. The free end of the outer flange is flared outwardly, to provide a snap-lock engagement means for the corner cap, as will be described in detail below. The inner and outer flanges together define a channel 32 that extends the length of the panel. The rounded outer faces of the outer flanges 30(*b*) facilitate installation of the decorative panel.

A portion of each of the sidewalls 14 bulges outwardly, and defines a recess 34 within the interior of the mouth 16. The recess is adapted to cooperate with the lip 20 to retain the decorative panel within the channel, as will be described below.

Figure 4:
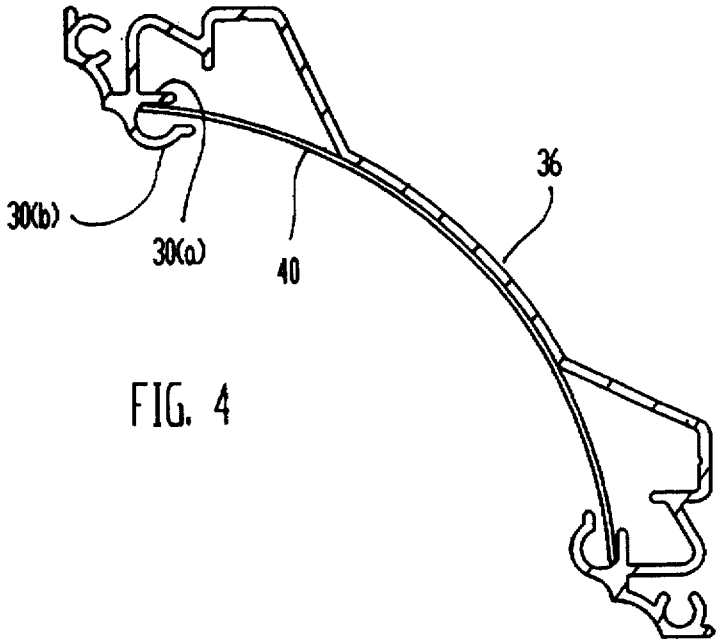
FIG. 4 is a sectional view showing a panel retained by the device in a concave position.

The floor of the moulding incorporates a concave center portion 36 to cradle a concavely-positioned decorative panel 40, as seen in FIG. 4.

The moulding may be mounted to a wall/ceiling intersection, as seen in FIG. 2, by way of screws 54 extending through the sidewalls 14 into a corresponding ceiling 52 and wall 50.

Decorative panels 4, 40 may be retained within the channel in either of two alternative positions. In the first configuration, seen in FIG. 2, the panel 4 is bowed outwardly as seen along its transverse axis. In this configuration, the panel should comprise a generally rigid striplike sheet, for example a sheet of PVC or aluminum that matches the vanes of a window blind installed within the room. The panel is installed by inserting its upper and lower side edges between the lips 20 and the floor of the channel, as seen in FIG. 3. Depending on the rigidity of the insert, it may be either snapped into position from the front of the moulding, or slid into position from the side. Once inserted, the upper and lower side edges of the panel are retained behind the flanges 30(*a*) and 30(*b*). One or both of the recesses 34 receives a corresponding side edge of the panel. The panel is biased outwardly against the lips 20 by means of an array of biasing means 35, which can comprise small strips of the panel material that have been folded over and positioned between the panel and the floor of the channel.

The same retention means may also be used to retain a generally planar panel, not shown.

In the second configuration, shown in FIG. 4, the panel 40 is retained in a concave position within the channel. The central portion of the panel rests against the concave center portion 36 of the moulding. A panel retained in this position may be relatively flexible, made for example from stiffened fabric or a fabric/plastic composite that retains a degree of rigidity. The concave retention prevents this type of panel from sagging or inadvertently releasing. In this configuration, the upper and lower side edges of the panel are inserted between corresponding pairs of flanges 30(*a*) and (*b*) of the upper and lower lips 20. The panel may be either slid sideways into position or, if the moulding is already installed, the panel may be flexed along its elongate axis and fitted into position from the front.

Figure 5:
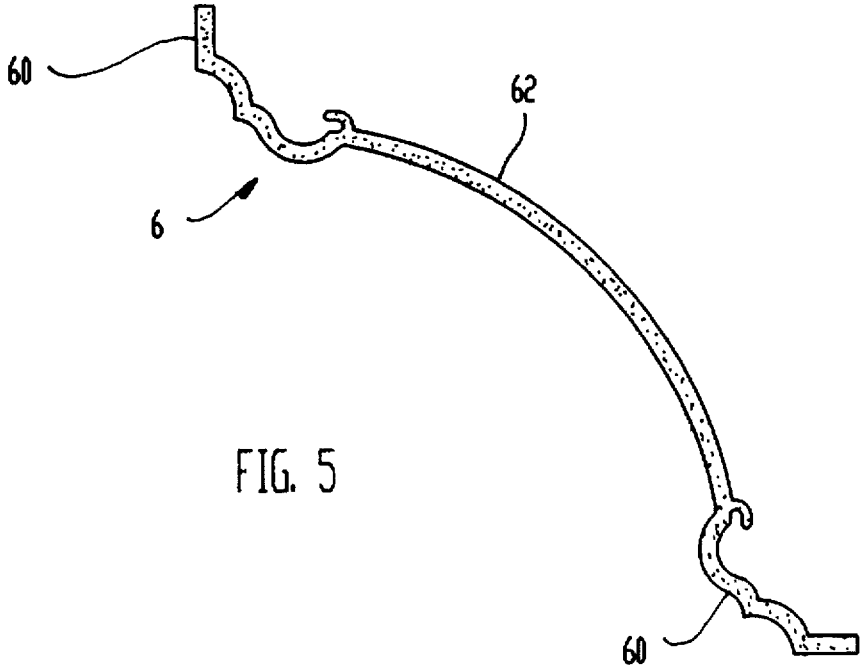
FIG. 5 is a sectional view of a first variant of a corner cap.
Figure 6:
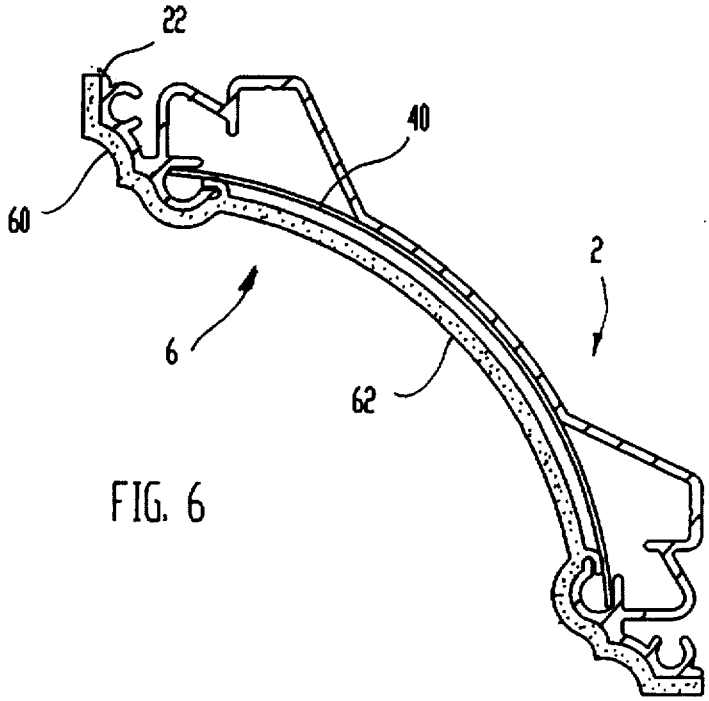
FIG. 6 is a sectional view of a corner cap installed on a moulding with a concave panel installed therein.
Figure 7:
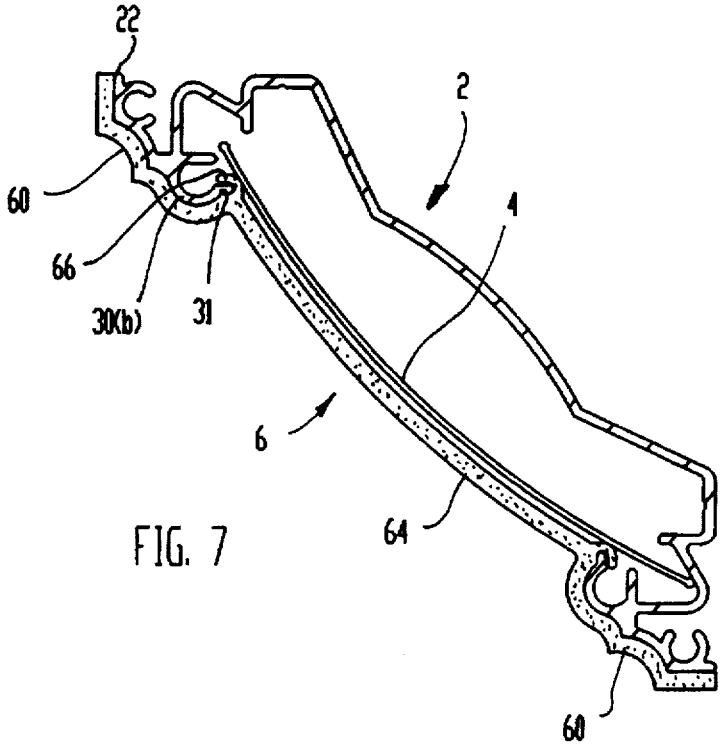
FIG. 7 is a sectional view as in FIG. 6 of a second variant of a cap and panel installation.

The corner caps 6, seen in cross-section in FIGS. 5–7, are snap-locked to the mouldings and are typically positioned to cover the exposed ends of the mouldings at a room corner. Each corner cap is generally L-shaped when seen in plan view. The caps each comprise upper and lower rims 60 and a faceplate 62, 64 that in a first embodiment seen in FIGS. 5 and 6 is concavely-bowed and in a second embodiment seen in FIG. 7 bows convexly, to accommodate the two preferred panel configurations respectively. The faceplate has a profile that corresponds generally with that of the panels 4, 40 and the profile of the rims 60 generally match those of the decorative border flanges 22 of the moulding, with the cross-sectional profile of the corner cap being somewhat larger than that of the corresponding elements of the mouldings to achieve a stepped appearance.

A hooked flange 66 extends along the inside of each of the upper and lower rims 60 and mates with an outwardly-flared end 31 of the outer flange 30(*b*) of the lip 20, to permit the cap to snap-lock onto the moulding.

The faceplate 62 of the first embodiment is shaped to permit an concavely-bowed decorative panel 40 to be received between the cap and the moulding. The panel may be positioned under the cap by simply sliding the panel into position under the cap or, alternatively, the cap may be snap-locked into position over the panel after the panel has been installed within the moulding. The snap-lock engagement of the cap to the moulding permits the panel to be easily replaced or installed after installation of the valance.

In the second embodiment, seen in FIG. 7, the faceplate 64 is convexly-bowed to accommodate a convexly-bowed panel 4. A gap is maintained between the faceplate and the floor of the moulding sufficient to permit the panel to slide therebetween.

It will be seen that although the embodiment described herein comprises crown moulding, the invention can be readily adapted to other types of mouldings wherein it is desired to provide a replaceable decorative face. For example, the invention may with suitable adaptations comprise a baseplate or chair rail moulding or the mouldings may be installed in a box-like configuration extending away from a wall to comprise a valance for installation above a window or the like. Other adaptations of the invention can include uses in cabinetry and trim around windows and doors and the like.

We claim:

1. An elongate decorative moulding adapted to releasably retain a decorative panel, said decorative panel comprising a generally striplike sheet having upper and lower side edges, said moulding having a front face characterized by an elongate channel extending the length of said moulding, said channel being defined by forwardly-extending upper and lower sidewalls an open mouth and a recessed floor, said upper and lower sidewalls incorporating retention means adapted to releasably retain an elongate decorative panel within said channel, said retention means partly occluding the mouth of the channel and each comprising a pair of extensions each of said extensions extending backwardly and having a free end generally facing the floor of said channel, said retention means being adapted to retain the panel in alternately a generally concave position wherein the upper and lower side edges of said panel are each adapted to be retained between a respective pair of said extensions, or in a generally planar or convex position wherein said panel is adapted to be retained between the free ends of said extensions and the floor of said channel.

2. A moulding as in claim 1, wherein said floor is characterized by a generally concave central portion, when viewed from the front, shaped to cradle a panel retained within said channel in a concave configuration.

3. A moulding as in claim 1, wherein said sidewalls are outwardly bowed to provide a recessed portion within said channel for the retention of a panel positioned in a generally planar or convex orientation.

4. A moulding as in claim 1, wherein said each pair of extensions comprise a pair of parallel elongate flanges extending substantially the length of said channel.

5. A moulding as in claim 4, wherein each pair of said flanges comprises a first generally flat flange and a second outwardly bowed flange, when seen in cross-sectional profile, said second flange shaped to provide a snap-lock engagement of said panel into said channel.

6. A moulding as in claim 1 adapted for use as a component of a crown moulding.

7. A moulding as in claim 1 adapted for use as a component of a baseplate moulding.

8. A moulding as in claim 1 adapted for use as a component of a valance.

9. A decorative moulding comprising an elongate generally flexible decorative panel, said decorative panel comprising a generally striplike sheet having upper and lower side edges, said panel being releasably retained within an elongate retainer member having an elongate channel defined by upper and lower sidewalls, an open mouth and a recessed floor, said upper and lower sidewalls each incorporating retention means for the releasable retention of said panel, said retention means partly occluding the mouth of the channel and each comprising a pair of extensions each extending backwardly and having a free end canted generally facing the floor of the channel, said retention means retaining said panel in alternately a generally concave position wherein the upper and lower side edges of said panel are each retained between a corresponding pair of said extensions, or in a generally planar or convex position wherein said panel is retained between the free ends of said extensions and the floor of said channel.

10. A moulding as in claim 9, wherein said floor is characterized by a generally concave central portion, when viewed from the front, shaped to cradle said panel in a concave position within said channel.

11. A moulding as in claim 9, wherein said panel is retained in a generally concave position within said retainer member and the upper and lower side edges of said panel are each retained between a corresponding pair of said extensions.

12. A moulding as in claim 9, wherein said panel is generally planar and the upper and lower side edges of said panel are each retained between the free edges of the extensions and the floor of the channel.

13. A moulding as in claim 9, wherein said panel is generally convex when installed in said retainer member and the upper and lower side edges of said panel are each retained between the free edges of the extensions and the floor of the channel.

14. A moulding as in claim 9 further comprising a cap adapted to cover an exposed end of said mounding, said cap having an exterior cross-sectional configuration generally matching and covering that of the retainer member and decorative panel, said moulding and said cap each having mating snap-lock engagement means for releasable retaining said cap to said moulding, said cap providing when engaged to said moulding an upwardly-stepped appearance at a junction of said cap and said moulding.

15. A moulding as in claim 9 having the configuration of a crown moulding.

16. A moulding as in claim 9 having the configuration of a baseplate moulding.

17. A moulding as in claim 9 having the configuration of a valance.

18. A moulding as in claim 9, wherein said extensions each comprise an elongate flange extending substantially the length of said channel.

* * * * *